US006325746B1

(12) United States Patent
Wang et al.

(10) Patent No.: US 6,325,746 B1
(45) Date of Patent: Dec. 4, 2001

(54) CLAMPING CUSHIONING MECHANISM FOR AN EXERCISE APPARATUS

(76) Inventors: Leao Wang; Peter Wu, both of No. 1, Lane 233, Sec. 2, Charng Long Rd., Taiping 411 (TW)

( * ) Notice: Subject to any disclaimer, the term of this patent is extended or adjusted under 35 U.S.C. 154(b) by 0 days.

(21) Appl. No.: 09/596,689

(22) Filed: Jun. 19, 2000

(51) Int. Cl.[7] ..... A63B 22/00
(52) U.S. Cl. ..... 482/54; 482/51
(58) Field of Search ..... 482/54, 51, 57, 482/70, 148

(56) References Cited

U.S. PATENT DOCUMENTS 5,072,928 * 12/1991 Stearns et al. ..... 482/54
5,827,155 * 10/1998 Jensen et al. ..... 482/54
5,989,161 * 11/1999 Wang et al. ..... 482/54
6,068,578 * 5/2000 Wang ..... 482/54

* cited by examiner

*Primary Examiner*—Stephen R. Crow
(74) *Attorney, Agent, or Firm*—Dougherty & Troxell; Kuo-Hsiung Chiu

(57) ABSTRACT

The present invention relates to a cushioning mechanism for an exercise apparatus disposed between a turning shaft under the main body of the exercise apparatus and a supporting element. The clamping cushioning mechanism includes two clamping bodies corresponding in form each of which contains a clamping element between which a receiving part is formed for fastening a cushioning soft pad. Thereafter, a rolling shaft is disposed at the relatively external side of each of the two clamping bodies so that, when a frame is loaded and pressed down, the stress will be transmitted from the turning shaft to two clamping bodies while the clamping bodies sink because pivoting holes at the relative center are loaded, however, the rolling shaft at two side thereof create an upward reactive force by means of their contact with the supporting element so that the clamping elements of the clamping bodies are enable to be clamped inwardly in order to achieve an expected cushioning effect.

1 Claim, 2 Drawing Sheets

CLAMPING CUSHIONING MECHANISM FOR AN EXERCISE APPARATUS

BACKGROUND OF THE INVENTION

1. Field of the Invention

The present invention relates to a clamping cushioning mechanism for an exercise apparatus, and more particularly, to an improvement with a quiet and stable cushioning effect.

2. Description of the Prior Art

A great force is applied to the main body of all kinds of exercise apparatuses (e.g. treadmill, jogging machine, skateboard, etc.) when the user uses it. Therefore, in order to protect the main body from shaking due to the applied force, a cushioning member is generally installed at a proper position for reducing the shaking trouble.

However, a spring or a soft pad is directly installed between the supporting member and the ground. In a word, the spring or the soft pad is directly pressed by the stress transmitted by the supporting element to create a deformation thereof and then to achieve a cushioning effect. When the above-mentioned external force disappears, it restores itself by means of the resilient force. This kind of the conventional cushioning mechanism has been used for many years without any serious disadvantages. However, when the spring or the soft pad restores itself, a reactive force will be created upon the supporting member. Consequently, the user must feel a little shaking. Regretfully, the user or the manufacturer takes it for granted.

In addition, the telescopic effect of the spring will easily produce an unpleasant rubbing noise, and the user or the manufacturer uses lubricant to temporarily solve this trouble in a passive manner. Moreover, the soft pad easily deforms itself due to the directly forced way, and it should be replaced regularly or irregularly.

SUMMARY OF THE INVENTION

It is a primary object of the present invention to provide a clamping cushioning mechanism for an exercise apparatus which can remove the above mentioned disadvantages without influence upon the original functions and is able to remove the reactive force smoothly in order to enhance the using comfort of the exercise apparatus.

BRIEF DESCRIPTION OF THE DRAWINGS

The accomplishment of this and other objects of the invention will become apparent from the following description and its accompanying drawing of which.

DETAILED DESCRIPTION OF THE PREFERRED EMBODIMENT

Figure 1:
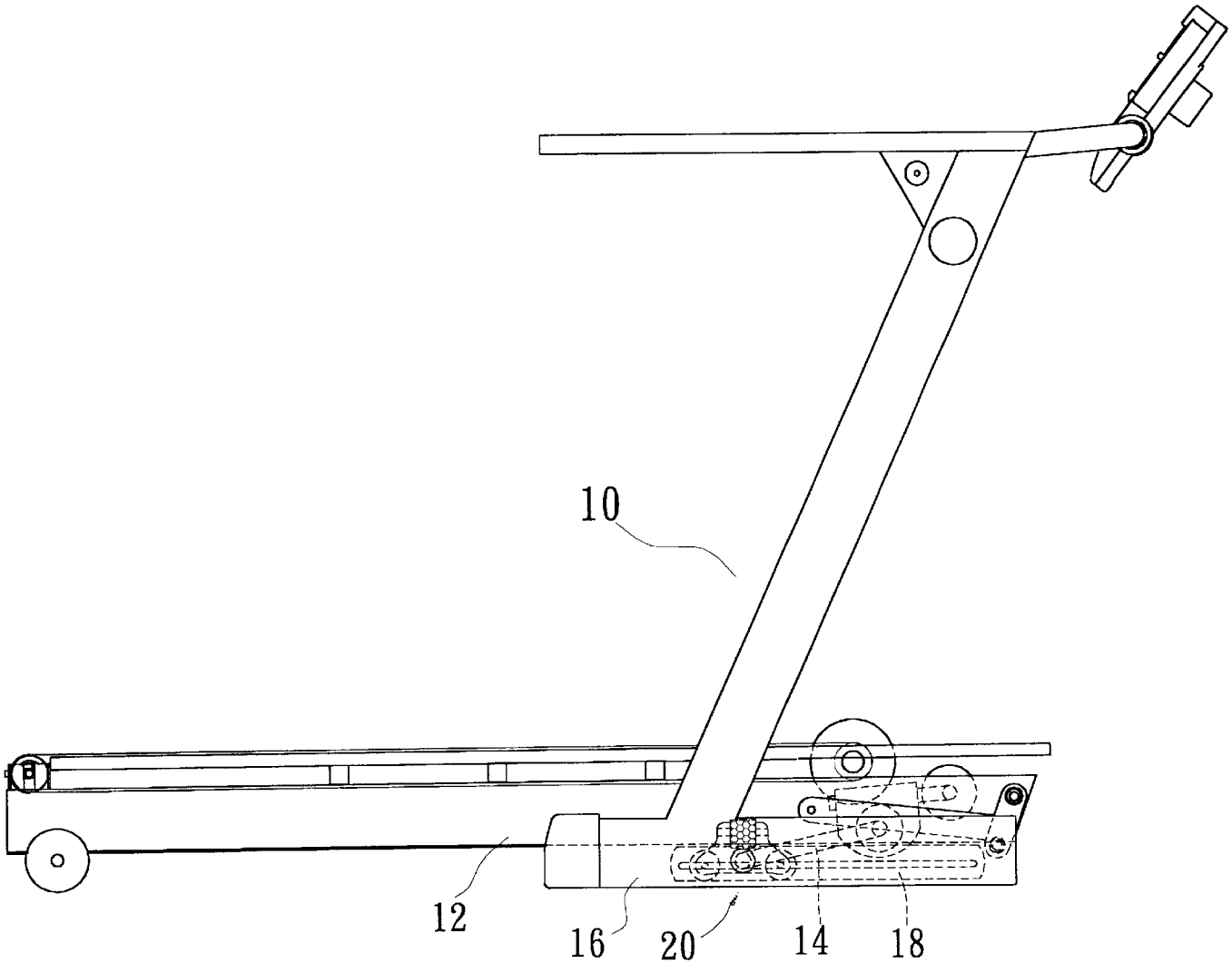
FIG. 1 is a preferred embodiment of the present invention applied to an electrical treadmill.
Figure 2:
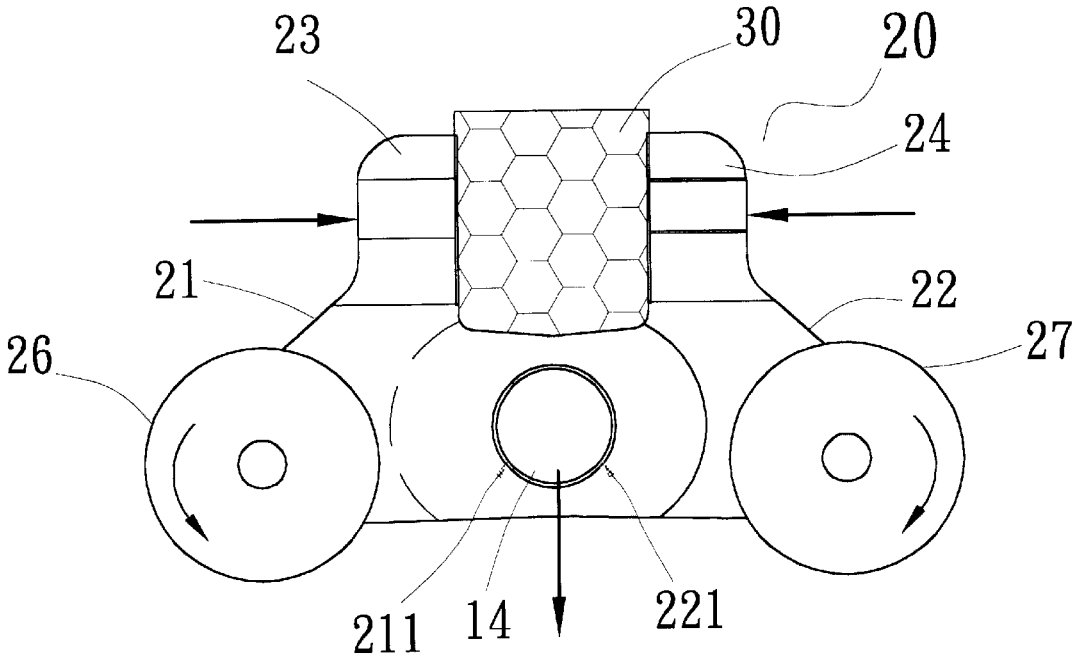
FIG. 2 is a schematic drawing of the present invention, illustrating the loading of the present invention and its removal of the reactive force.

First of all, referring to FIGS. 1 and 2, they show a preferred embodiment of the present invention applied to an electrical treadmill 10. From the drawings, it's apparent that the frame 12 of the electrical treadmill 10 is coupled with a turning shaft 14, and that a clamping cushioning mechanism 20 is pivoted between the turning shaft 14 and a supporting element 16, wherein the clamping cushioning mechanism 20 includes two clamping bodies 21, 22 corresponding in form which contain claimping elements 23, 24 respectively between which a receiving part is formed for receiving a cushioning soft pad 30; thereafter, a rolling shaft 26, 27 is disposed at the relatively external side of each of two clamping bodies 21, 22 so that, when the frame 12 is loaded and pressed down, the stress will be transmitted from the turning shaft 14 to two clamping bodies 21, 22 while the clamping bodies 21, 22 sink because the pivoting holes 211, 221 at the relative center are loaded, however, the rolling shaft 26, 27 at two side thereof create anclaimupward reactive force by means of their contact with the supporting element 16 so that the clamping elements 23, 24 of the clamping bodies 21, 22 are enable to be clamped inwardly in order to achieve an excellent cushioning effect.

Furthermore, referring to FIG. 2, when the clamping bodies 21, 22 restore themselves after the external force disappears, the rolling shafts 26, 27 at two sides slide on the slide rail 18 of the supporting element 16 in the loading direction, that is, it slides in the direction of the relatively external side when loaded while it slides in the direction of the relatively internal side when it restores itself. Accordingly, the reactive force can be effectively removed in order to minimize the reactive force transmitted back to the frame and to achieve an excellent user comfort.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A clamping cushioning mechanism for an exercise treadmill having a frame and supporting element, the mechanism comprising:

a) first and second spaced apart rolling shafts slidably engaged with the supporting element;

b) turning shaft connected to the frame;

c) first and second clamping bodies, each connected to one of the first and second spaced apart rolling shafts, and both clamping bodies connected to the turning shaft at a location between the spaced apart rolling shafts, the first and second clamping bodies having a receiving part therebetween; and, d) a cushioning pad located in the receiving part such that opposite sides of the cushioning pad are contacted by the first and second clamping bodies.

* * * * *